United States Patent [19]

Sardo, Jr.

[11] 4,399,722

[45] Aug. 23, 1983

[54] SOCKET WRENCH INCLUDING QUICK-RELEASE ADAPTOR

[76] Inventor: Vincent Sardo, Jr., 220 W. Skyline Lakes Dr., Ringwood, N.J. 07456

[21] Appl. No.: 241,224

[22] Filed: Mar. 6, 1981

[51] Int. Cl.[3] ..... B25B 13/46

[52] U.S. Cl. ..... 81/60; 81/177 G

[58] Field of Search ..... 81/177 G

[56] References Cited

U.S. PATENT DOCUMENTS

| | | | |
|---|---|---|---|
| 3,172,675 | 3/1965 | Gonzalez | 81/177 G |
| 3,208,318 | 9/1965 | Roberts | 81/177 G |
| 3,378,905 | 4/1968 | Szohatzky | 81/177 G |
| 3,532,013 | 10/1970 | Haznar | 81/177 G |
| 4,218,940 | 8/1980 | Main | 81/177 G |
| 4,297,924 | 11/1981 | Stephens | 81/177 G |
| 4,317,392 | 3/1982 | Stephens et al. | 81/177 G |

*Primary Examiner*—James L. Jones, Jr.
*Attorney, Agent, or Firm*—Spellman & Joel

[57] ABSTRACT

An improved pushbutton quick-release socket wrench includes an adaptor which comprises a hollow elongated member having a spring-loaded elongated member mounted axially within a central recess. A ball extends through the side wall of the member at one end of the member to engage a bearing recess in a socket which mounts to one end of the adaptor. A cam portion of the spring-loaded elongated member permits coupling of the ball to the mating socket when a plunger button on the wrench is depressed. Releasing the button drives the ball into contact with the socket recess to provide an integral structure for operating purposes. The adaptor is coupled to the driving stud of the wrench by driving a protruding ball into contact with a mating hole on the other end of the adaptor. The ratchet structure with a hollow stud extending therefrom with an axial plunger is mounted within a toothed recess in the wrench handle. Depressing the actuating button enables the ball to make contact with the adaptor recess to lock the adaptor thereto and also permits the socket to be connected to the other end by the cam action of the elongated member.

5 Claims, 3 Drawing Figures

SOCKET WRENCH INCLUDING QUICK-RELEASE ADAPTOR

BACKGROUND OF THE INVENTION

This invention relates to socket wrenches, and particularly to quick release adaptors to extend the reach of such wrenches.

The prior art includes U.S. Pat. No. 3,208,318 to P. M. Roberts which discloses the basic quick release arrangement for socket wrenches. In the Roberts patent, a removable socket is used in direct combination with a driver, the latter having means such as a ball or detent for holding the socket thereto during the operation of the wrench and a new and improved means for releasing the socket. The release means in Roberts includes a ball and detent arrangement activated by a pushbutton. The patent achieves significant advantages in permitting pushbutton removal of the socket from the wrench particularly when the sockets are small and the user's hands are greasy. The patent, however, does not disclose an arrangement whereby a quick release arrangement can be used in conjunction with a socket wrench to reach relatively inaccessible positions with an adaptor when one is required.

U.S. Pat. No. 3,467,231 to H. J. Haznar pertains to a pawl reversing mechanism for ratchet wrenches of the type utilized herein. The later Haznar U.S. Pat. No. 3,523,013, discloses a quick release mechanism for fine tooth ratchet wrenches in which a reversing bolt is centrally located in the body of a driver stud carrying member. The Haznar patents are of interest in that they disclose a ratchet wrench of the general type to which the present invention is directed and represents an improvement thereover.

U.S. Pat. No. 4,218,940 to D. Main discloses a remote socket release apparatus for wrenches wherein the release actuation mechanism is located on the outer end of the wrench handle. The Main disclosure is not concerned with adaptors for use with quick-release socket wrenches.

The Szohatzky U.S. Pat. No. 3,378,905 is also of general interest. Szohatzky discloses a preswaging tool including an assembly head which cooperates with a spring-loaded ball member to lock the head to a shaft.

In summary, none of the prior art patents appear to disclose the unique combination of features which comprise the invention herein. Of course, other patents, which are unknown to the inventor may exist and be pertinent to the disclosure but none has so far come to the inventor's attention.

SUMMARY OF THE INVENTION

This invention relates to adaptors for extending the reach of quick-release socket wrenches. In the invention, the adaptor is mounted to the wrench at one end with the socket coupled to its other end. The socket and the adaptor itself may be sequentially released from the wrench assembly by depressing a button to predetermined successive positions with the improved design of the quick-release socket wrench.

The adaptor is a hollow elongated body having an enlarged head at one end with an aperture extending through the side wall thereof and an enlarged axial recess in said end. The side aperture is designed to engage a protruding ball on a stud or driving member which extends downwardly from the wrench and engages the recess. An elongated spring-loaded member extends axially through the hollow adaptor with one end engaged by a plunger element in the wrench driving member for actuation purposes.

The other end of the spring-loaded plunger extends outwardly from the central recess in the elongated member. The adaptor has a substantially square cross-section on the outer end thereof to engage the aperture in a socket. The straight walled square end portion includes a protruding ball which cooperates with a cam portion of the plunger to permit engagement and disengagement from a socket when the plunger is actuated.

In operation the adaptor and socket may be removed one at a time from the wrench by pushing the button on the wrench activating the plunger element to first disconnect the socket therefrom and then upon further depression of the plunger, disconnect the adaptor therefrom. The arrangement permits use of an extension with a quick connect socket wrench which heretofore has not been possible particularly in such an easy and expeditious manner. The present invention comprises an adaptor or extention used in combination with a quick-release wrench of an improved design which represents an improvement over the current generation of quick-release socket wrenches. The adaptor is relatively inexpensive to manufacture, easy to operate, durable and interchangeable with sockets of various sizes. The adaptor may also be manufactured in various lengths and sizes while still maintaining the advantages thereof.

Accordingly, an object of this invention is to provide a new and improved adaptor and quick-release socket wrench.

Another object of this invention is to provide a new and improved adaptor which can be readily connected to a wrench at one end and to a socket at the other end by the pushing of a single button.

A more specific object of this invention is to provide a quick-release adaptor and socket wrench wherein the adaptor utilizes a ball and detent arrangement for coupling both to the wrench at one end and to the socket at the other end and wherein the socket and adaptor may be removed independently from the wrench by pushing a button to predetermined depths.

BRIEF DESCRIPTION OF THE DRAWINGS

Other objects and advantages of this invention may be seen from the following description when viewed in conjunction with the accompanying drawings wherein.

DETAILED DESCRIPTION OF THE DRAWINGS

Figure 1:
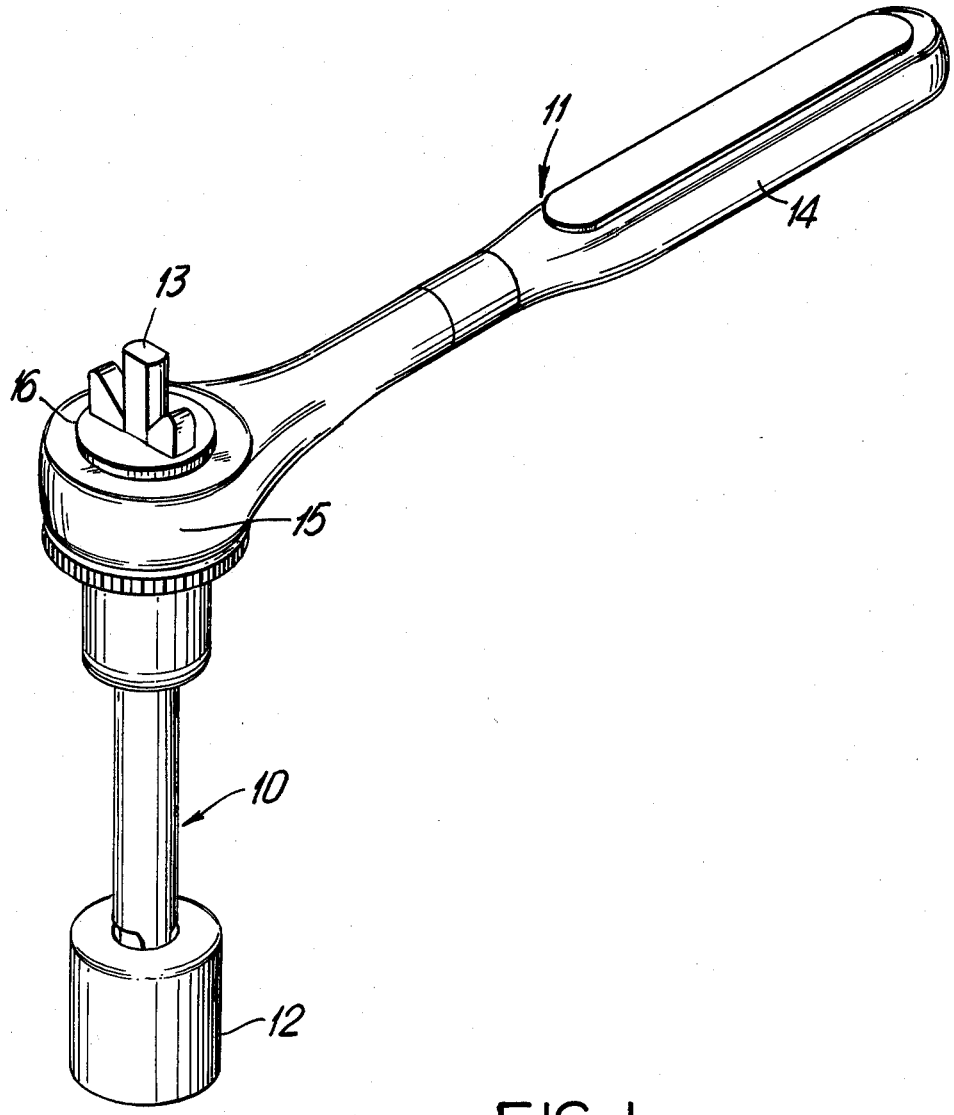
FIG. 1 is a perspective view of the socket wrench and adaptor combination.
Figure 2:
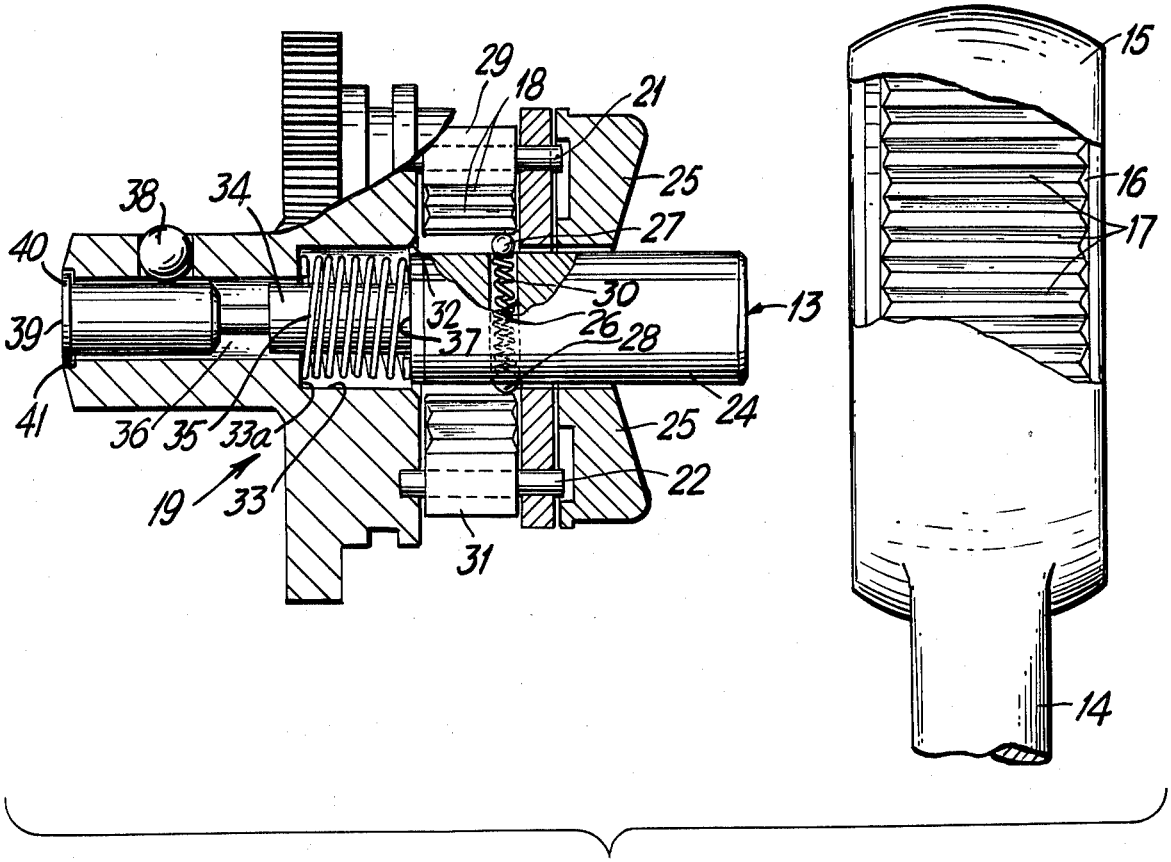
FIG. 2 is a cut-a-way exploded view partially in cross-section showing the details of the wrench-adaptor combination.

Referring now to FIG. 1 of the drawings, the invention comprises a new and improved quick release wrench having an adaptor or extension 10 for use therewith. The adaptor 10 is connected to the wrench 11 at one end and has a socket 12 of preselected size coupled thereto at the other end. Adaptors 10 of various sizes may be utilized in conjunction with the wrench 11 to perform operations in inaccessible or crowded quarters particularly where it is impossible to fit a conventional wrench arrangement.

The quick release feature is provided by button 13 which is pushed downwardly to connect and disconnect the adaptor 10 and socket 12 to the wrench 11. In the release operation, depressing the button 13 to an initial predetermined depth releases the socket 12 from the adaptor 10 so that another socket can be fitted thereon if so desired. Further depressing the adaptor 10 releases it from the wrench 11. Conversely, in order to secure the adaptor 10 on the wrench 11, it is necessary to press in the button 13 and then fit the adaptor 10 on the wrench 11 and then the socket 12 on the adaptor 10.

The wrench 11 includes a handle 14 and an enlarged head 15 having an aperture 16 extending centrally therethrough. The walls of the aperture 16 include a plurality of internal vertical teeth 17 which are engaged by the spring-loaded teeth 18 on the insert 19 which fits into said aperture 16. The teeth 18 are contained on two sectors or pawls which are pivotally connected in a recessed portion of the insert 19 by pins 21 and 22 to drive the socket 12 in a predetermined direction.

The insert 19 includes a shaped pushbutton 13 with a plunger portion which extends centrally through the insert 19 and protrudes outwardly therefrom. The button and plunger combination 13 is a one piece member which can be rotated clockwise or counterclockwise. This contrasts with the prior art such as U.S. Pat. No. 3,532,013 to H. J. Haznar wherein the socket release button must be separate from the plunger pin in order to permit reversable movement.

The button 13 is essentially an elongated member having sections of different diameters and includes a large diameter section 24 extending outwardly between raised portions 25 of the insert 19 for purposes of actuation. The button also includes a transverse aperture 26 in section 24 having a ball 27, 28 protruding from each end under the urging of spring 30 to cooperate with toothed pawls 29, 31. The balls 27, 28 not only press the toothed pawls outwardly against the wrench handle teeth 17 but they also provide a detent between the first and second positions when pushing the button to predetermined depths. The edge surface 32 is slightly beveled to provide a distinct stop position when the balls 27, 28 reach this position. If the button 13 is pressed harder, the balls 27, 28 compress spring 30 into aperture 26 permitting the button plunger 13 to continue its movement into bore 33.

The larger diameter section 24 leads to a smaller diameter section 34 having a coiled spring 35 wrapped thereabout to restrict the movement of button 13. The spring extends between stop 33*a* and the end surface 37 of the larger diameter section 24. The section 24 also includes a circumferential groove 36 spaced from the end portion thereof to cooperate with detent ball 38. The first depression of the button 13 allows the plunger point 39 to move outwardly from bore 33 and actuates the release mechanism of the adaptor extension 10.

Figure 3:
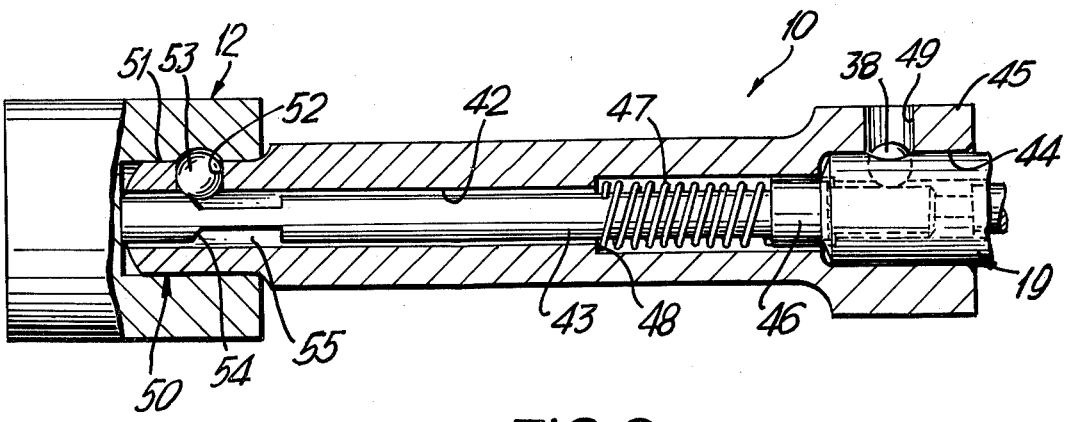
FIG. 3 is a cross-sectioned view of the adaptor portion of the invention appearing in FIG. 1.

As shown in FIG. 3, the adaptor 10 comprises an elongated member of a preselected variable length having a hollow bore 42. An elongated plunger element 43 is slidably mounted within the bore 42 with the head portion 46 protruding therefrom within the recess 44 in enlarged portion 45. A coiled spring 47 is mounted about element 43 and extends from the head 46 to the stop 48 to maintain the plunger element 43 in a fixed non-actuated position.

The adaptor 10 also includes an aperture 49 in enlarged portion 45 which cooperates with the ball 38 in the insert 19 to fixedly connect the adaptor 10 and insert 9. The opposite end 50 of the adaptor 10 comprises a side portion having four substantially flat faces 51 and an aperture 52 extending therethrough with sloping walls to retain ball 53 therein. The ball 53 is actuated by the sloping face 54 of element 43 to protrude outwardly and engage a recessed locking portion in the socket 12 when the adaptor 10 is being used. When the socket 12 is being disengaged the ball 53 retreats into the plunger groove 55.

Thus, the invention provides an improved pushbutton quick-release socket wrench 11 wherein a socket 12 may be readily connected and disconnected from an adaptor 10 which in turn is readily connected and disconnected from a wrench insert 19 in a two step operation. The arrangement permits use of an extension or adaptor 10 with a quick connect socket wrench in an advantageous and expeditious manner.

It is understood that the above-described arrangements are merely illustrative examples of the application. Numerous other arrangements may be readily devised by those skilled in the art which will embody the principles of the invention and fall within the spirit and scope thereof.

I claim:

1. A socket wrench comprising:

a wrench portion including an elongated handle and a head portion at one end with an aperture therethrough, an insert mounted within the head aperture and driving means coupling the insert to the head portion, said insert being rotatably driven by the action of the wrench portion upon actuation thereof through the driving means and said insert having an aperture extending axially therethrough, and including an elongated pushbutton slidably mounted within the axial aperture and normally protruding therefrom at one end and a stud portion at the other end from which the pushbutton moves outwardly when depressed at its other end, a socket having a body portion, upper and lower axial apertures, a first inner portion in the upper aperture comprising interior walls having at least one locking recess therein and a second outer portion in the lower aperture of enlarged diameter comprising interior walls having gripping means spaced thereabout, and, a one piece hollow adaptor having means at one end to removably engage the insert stud, said means being coupled to the pushbutton for actuation thereby and coupling means at one end to engage a locking recess in the upper socket aperture, a slidable shaft mounted axially within the adaptor and in engagement therewith and engageable by the pushbutton at one end to be moved downwardly within the adaptor to actuate the coupling means cooperating with the socket and whereby depressing the pushbutton a first distance selectively actuates the coupling means to disengage the shaft from the locking recess in the socket wall releasing the socket from the adaptor and further depression of the pushbutton disengages the adaptor engaging means from the stud freeing the adaptor from the insert.

2. A socket wrench in accordance with claim 1 wherein:

the adaptor comprises an elongated member having an enlarged head portion, an aperture extending axially therethrough, a transverse aperture in the head portion and a second transverse aperture located at the opposite end, and wherein the slidable shaft comprises an elongated member positioned within the axial aperture and having a grooved portion of lesser diameter located adjacent one end, a ball mounted in the second transverse aperture normally in engagement with a locking recess on the socket wall and with the shaft outer surface and being released from engagement with the socket upon movement of the grooved shaft portion adjacent the ball upon actuation of the pushbutton.

3. A socket wrench in accordance with claim 1 wherein:

the insert includes a stud portion protruding at one end for coupling to the adaptor, said stud portion having a transverse aperture in one wall thereof and an axial aperture with said pushbutton extending outwardly therefrom and having a grooved internal portion for positioning opposite the transverse aperture upon movement of the pushbutton and a ball mounted in the transverse aperture to engage the transverse aperture in the adaptor for coupling purposes, said ball being positioned for sequential operation after engagement of the adaptor with the socket.

4. A socket wrench in accordance with claim 2 wherein:

the axial aperture in the adaptor is of different diameters for predetermined distances, one of said diameters forming an internal shoulder at the junction with a lesser diameter and spring means mounted about the shaft and resting on said shoulder at one end and wherein the shaft includes a shoulder to be engaged by the spring at its other end to maintain the shaft in an unoperated position.

5. A socket wrench in accordance with claim 2 wherein:

the grooved portion includes a sloped wall at the outer end leading to the lesser diameter to cam the ball into locking engagement with a socket recess.

* * * * *